US005667260A

United States Patent [19]

Weyerstall

[11] Patent Number: 5,667,260

[45] Date of Patent: Sep. 16, 1997

[54] MOTOR VEHICLE DOOR LOCK WITH A ROTARY CENTRAL INTERLOCK

[75] Inventor: Bernd Weyerstall, Wuppertal, Germany

[73] Assignee: Robert Bosch GmbH, Germany

[21] Appl. No.: 584,009

[22] Filed: Jan. 11, 1996

[30] Foreign Application Priority Data

Jan. 10, 1995 [DE] Germany ..... 195 00 509.0

[51] Int. Cl.[6] ..... E05C 3/06

[52] U.S. Cl. ..... 292/201; 292/DIG. 23; 292/DIG. 27

[58] Field of Search ..... 292/201, 144, 292/DIG. 23, DIG. 27

[56] References Cited

U.S. PATENT DOCUMENTS

| | | | |
|---|---|---|---|
| 4,135,377 | 1/1979 | Kleefeldt et al. | 70/264 |
| 4,257,634 | 3/1981 | Kleefeldt et al. | 292/336.3 |
| 4,342,209 | 8/1982 | Kleefeldt | 70/264 |
| 4,364,249 | 12/1982 | Kleefeldt | 70/264 |
| 4,518,181 | 5/1985 | Yamada | 292/201 |
| 4,569,544 | 2/1986 | Escaravage | 292/216 |
| 4,601,500 | 7/1986 | Bernard | 292/201 |
| 4,763,936 | 8/1988 | Rogakos et al. | 292/201 |
| 4,948,183 | 8/1990 | Yamada | 292/199 |
| 4,986,579 | 1/1991 | Ishikawa | 292/201 |
| 5,020,838 | 6/1991 | Fukumoto | 292/201 |
| 5,079,964 | 1/1992 | Hamada et al. | 74/89.15 |
| 5,106,133 | 4/1992 | Fukumoto et al. | 292/201 |
| 5,149,156 | 9/1992 | Kleefeldt | 292/336.3 |
| 5,240,296 | 8/1993 | Kobayashi | 292/201 |
| 5,419,597 | 5/1995 | Brackmann et al. | 292/201 |
| 5,441,315 | 8/1995 | Kleefeldt et al. | 292/201 |
| 5,538,298 | 7/1996 | Ikeda | 292/201 |
| 5,564,308 | 10/1996 | Hoshikawa et al. | 74/89.14 |
| 5,584,515 | 12/1996 | Silye | 292/201 |

*Primary Examiner*—Steven N. Meyers
*Assistant Examiner*—Donald J. Lecher
*Attorney, Agent, or Firm*—Sixbey, Friedman, Leedom & Ferguson, PC; David S. Safran

[57] ABSTRACT

A motor vehicle door lock with locking elements such as rotary catches and detent pawls, with a lock mechanism (1) and with a central interlock drive (2), in which the central interlock drive (2) has a drive motor (3), a rotor (5) that is driven in a rotating manner by the drive motor (3), preferably with the aid of worm-gear transmission, and an actuating part which is arranged on the rotor (5) and which can be brought into a disengaged position (D), a locking position (L) and, preferably, an anti-theft locking position (A), optionally also into a neutral position (N), and in which locking mechanism (1) has an inside opening lever (7), an outside opening lever (9) and other levers as well as a central interlock lever (11) that can be displaced by the actuating part (6). So that blocking of the rotor of the central interlock drive does not lead to a permanent blocking in the locking position or in anti-theft locking position, it is provided that actuating part (6) on rotor (5) can be moved radially with respect to the rotor (5), and is spring-loaded radially outward and thus in the case of a blocking of central interlock drive (2), with sufficient force, it can be radially deflected in an intermediate position and allows release or unlocking of the door lock.

11 Claims, 2 Drawing Sheets

MOTOR VEHICLE DOOR LOCK WITH A ROTARY CENTRAL INTERLOCK

BACKGROUND OF THE INVENTION

1. Field of the Invention

The invention relates to a motor vehicle door lock with a lock mechanism, such as rotary latches and detent pawls, and with a central interlock drive which has a drive motor, a rotor that is driven in a rotating manner by the drive motor, preferably with the aid of a worm-gear transmission, and an actuating part which is arranged on the rotor and which can be brought into a release position, a locking position, and preferably, an anti-theft locking position, optionally also into a neutral position. More specifically, to such a door lock in which the locking mechanism has an inside opening lever, an outside opening lever and other levers as well as a central interlock lever that can be displaced by the actuating part.

2. Description of the Related Art

Motor vehicle door locks of the type in question are known in various embodiments. The motor vehicle door lock on which the invention is based (U.S. Pat. No. 5,240,296) has a central interlock drive with a drive motor and a rotor which is turned by the drive motor with the aid of a worm-gear transmission. An actuating part in the form of a projecting pin is located near the periphery of the rotor and thus rotates eccentrically. The actuating part can be brought with the aid of the rotor into a release position and a locking position as well as into an intervening neutral position.

The actuating part acts in combination with a central interlock lever of the lock mechanism, which is mounted to pivot about an axis that is parallel to the axis of rotation of the rotor and which has a T-shaped section with a base leg that is directed radially outward. The release position and the locking position of the actuating part are located in the cross-piece of the T-shaped section at approximately opposite ends areas thereof. The central interlock lever is thus swung back and forth around its pivot axis between the release position and the locking position by the actuating part. This swinging movement then acts on the other levers in the lock mechanism.

In the case of the above-explained, known motor vehicle door lock, after a locking process or release process, the actuating part normally occupies a neutral position that lies in the center between the locking position and the release position, in the cross-piece of the T-shaped section. In this neutral position, the swinging movement of the central interlock lever between the locking position and the release position is not impeded.

An anti-theft locking position can be achieved in the above-explained motor vehicle door lock in which the rotor moves the actuating part into the locking position and disconnects the drive motor there. The actuating part is now stationary while blocking the central interlock lever in the locking position, pulling on the inside locking lever, or on the inside opening lever that can also achieve the inside locking, cannot lead to a unlocking of the door lock.

In order that the lever gear of the lock mechanism, in this design in which the central interlock lever is blocked in the anti-theft locking position, is not damaged, a coupling spring can be arranged between the inside locking lever or the inside opening lever that achieves the inside locking, on the one hand, and the central interlock lever, on the other hand. This coupling spring normally entrains one lever in the case of mechanical actuation of the other lever, but in the case of blocking the other lever, it allows a movement of one lever against the spring force.

If, in the case of the above-explained motor vehicle door lock, the central interlock drive is permanently blocked in the anti-theft locking position or in any other intermediate position for whatever reason, the central interlock lever cannot be moved and it is correspondingly permanently blocked. A repair in the workshop is unavoidable. Worse yet, without special additional measures, an emergency release or emergency unlocking of the motor vehicle door lock cannot be achieved via the outside locking lever to be actuated by the door lock. Rather, an additional chain of action of forces from the outside locking lever directly to the detent pawl of the motor vehicle door lock must be provided.

SUMMARY OF THE INVENTION

The primary object of the present invention is to configure a motor vehicle door lock of the type in question so that a blocking of the rotor of the central interlock drive does not lead to a permanent blocking in a locking position or in an anti-theft locking position.

This object is achieved in a motor vehicle door lock of the initially mentioned type by making the actuating part on the rotor radially displaceable relative to the rotor and spring-loaded in a radially outward direction so as to be radially deflectable against the spring-loading when the central interlock drive is blocked in an intermediate position for allowing unlocking of the door lock.

According to the invention, it has been recognized that a deflection of the actuating part on the rotor in the radial direction relative to the rotor is the correct means to obtain the required degree of freedom for an emergency unlocking in the case of a blocked central interlock drive. In a very simple way, the defined spring power can be allowed here by spring-loading of the actuating part radially outward, opposite which an emergency unlocking, especially from the outside locking lever, is possible.

Especially, an actuating part that can slide in a guide in the radial direction relative to the rotor is very simple to achieve. But also, an elastically deflecting, thus springy, actuating part can represent an alternative, if it is ensured that the necessary actuating forces can be transmitted to the levers in the peripheral direction.

These and further objects, features and advantages of the present invention will become apparent from the following description when taken in connection with the accompanying drawings which, for purposes of illustration only, show a single embodiment in accordance with the present invention.

DETAILED DESCRIPTION OF THE PREFERRED EMBODIMENT

Figure 1:
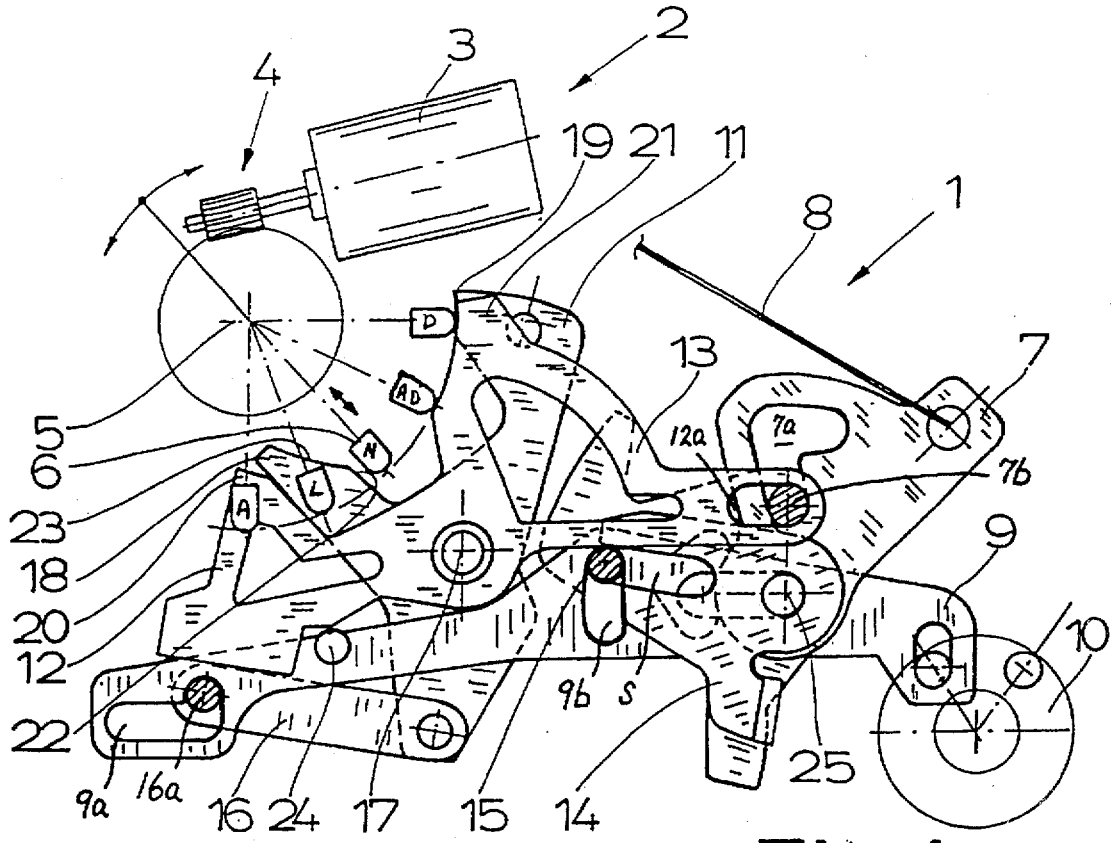
FIG. 1 shows the lock mechanism with the central interlock drive of a motor vehicle door lock according to the invention in the unlocked position.

The basic design of the motor vehicle door lock is explained first based on FIG. 1. This motor vehicle door lock has the usual locking elements, such as rotary latches and detent pawls, which are not further depicted here. Lock mechanism 1 and central interlock drive 2 can be seen. Central interlock drive 2 has a drive motor 3 and a rotor 5 that is rotated by the drive motor 3 and, according to preferred teaching, with the aid of worm-gear transmission 4. Rotor 5 has external teeth and itself forms the worm wheel of worm-gear transmission 4. An actuating part 6, which has the shape of a projecting pin, is located on rotor 5.

FIG. 1 shows that rotor 5 is rotated clockwise into the locking position and counterclockwise into the release position. The various positions that actuating part 6 can occupy when rotor 5 rotates, namely first a disengaged position D and a locking position L, are indicated.

In the embodiment that is shown and in this respect preferred, the rotor 5 can also bring the actuating part 6 into a neutral position N. This holds true in the embodiment presented, so that rotor 5, in principle, rotates bringing the actuating part 6 to neutral position N after each actuation. Any triggering of the central interlock drive 2, thus, results in a rotation of rotor 5 with actuating part 6 starting from neutral position N.

The mode of operation that is explained above is not required, the teaching of the invention can be used, advantageously, in principle also in a design of central interlock drive 2, in which the rotor 5 does not always return the actuating part 6 to the neutral position N. On the contrary, the teaching of the invention then applies even more extensively. But, the drive variant is now more likely the rarer one.

It is essential that motor vehicle door locks of the type in question can also have a so-called anti-theft locking function. In the anti-theft locking position, such a motor vehicle door lock is secured, so that even by pulling on the inside opening lever or on the inside locking lever a release or opening of the door lock is not produced. Only an actuation of the door locking cylinder itself is able to release the anti-theft locking. In the embodiment presented, the motor vehicle door lock is equipped with an anti-theft locking function, namely, by the fact that actuating part 6 can also be brought into an anti-theft locking position A or into an anti-theft-disengaged position AD that eliminates the anti-theft locking. The location of the various positions of actuating part 6 in the circular arc depicted in FIG. 1 makes it evident that, in the clockwise locking movement of the rotor 5, first the locking position L, then anti-theft locking position A is achieved. Beginning from neutral position N, first the anti-theft disengaged position AD and then the disengaged position D, in which the central interlock is released, is achieved.

In addition, FIG. 1 shows lock mechanism 1 which, in any case, has an inside opening lever 7 which, in the embodiment presented, is connected to a Bowden cable 8 leading to the inside opening handle. Also provided is an outside opening lever that is not depicted here, but which can also be connected the inside opening lever 7.

Present in the illustrated embodiment, but not necessarily provided, for example, on the rear side doors of motor vehicles, is an outside locking lever 9 to be actuated from a door locking cylinder. In the embodiment presented, this outside locking lever 9 is present and coupled in the usual way with a rotatable drive nut 10 from a door lock cylinder via a driver pin and an elongated hole. Nut 10 is also depicted as a rotor.

Finally, there is provided a central interlock lever 11 that can be displaced by the actuating part 6 and that disengages or locks the motor vehicle door locking elements of lock mechanism 1.

In the illustrated embodiment of a motor vehicle door lock with an anti-theft locking function, lock mechanism 1 also comprises an anti-theft locking lever 12 that can be displaced by the actuating part 6. Moreover, a power transmission lever 13 and an intermediate lever 14, both of which are coupled with a driver pin 15 of a detent pawl, which is not shown, are also provided. In addition, a connecting lever 16 is provided between the central interlock lever 11 and the outside locking lever 9.

How the individual levers of lock mechanism 1 interact in combination in the above-explained, preferred embodiment is explained below.

For the invention, it is, first, essential that the actuating part 6 on the rotor 5 is mounted to move, especially slide, radially relative to the rotor 5, and is spring-loaded radially outward. Thus when the central interlock drive 2 is blocked in an intermediate position with sufficient force, the actuating part 6 can be deflected radially to allow disengagement/unlocking of the door lock. This is indicated in the embodiment presented by the double arrow proximate the actuating part 6 at neutral position N in FIG. 1. If, for example, rotor 5 unexpectedly remains stationary with actuating part 6 in the anti-theft locking position A, the actuating part 6 can be pushed back radially relative to the axis of rotation of the rotor 5 by the anti-theft locking lever 12. As a result, the angular relations of the various parts with respect to one another are altered and a mechanical reverse rotation of rotor 5 is possible. Even without reverse rotation, disengagement or unlocking (opening) of the door lock can take place in this way if the corresponding spring course has a sufficient length.

In the embodiment presented, according to the explanation given above, neutral position N is provided for actuating part 6 of rotor 5, into which this rotor 5 normally always returns.

In addition, it is evident that central interlock lever 11 and/or anti-theft locking lever 12 (in the embodiment presented both levers) are mounted on an axis 17 that is parallel to the axis of rotation of rotor 5. Central interlock lever 11 and/or anti-theft locking lever 12 (in the illustrated embodiment both levers) are U-shaped, and in each case leg 18 or 19, or leg 20 or 21 of the U has a control edge which projects into the path of movement of actuating part 6, while other leg 19 or 18, or leg 21 or 20 of the U has a guiding edge which lies on the edge of the path of movement of actuating part 6. In FIG. 1, control edge 22 on left leg 18 of central interlock lever 11 and guiding edge 23 are identified, the reference numerals being left off of the corresponding edges of the right leg since, otherwise, the drawing would become too cluttered.

In the embodiment presented, it is provided that each of the legs 18, 19, 20, 21 has a control edge 22 and an adjoining guiding edge 23. In this case, it is achieved, according to preferred teaching, that the guiding edge 23 is positioned on the edge of the path of movement of actuating part 6 ruing crosswise to the radial direction of rotor 5, the surface 23 being orthogonal to the radial direction of rotor when it is positioned on the peripheral edge of the line of movement of the actuating part 6. The actuating part 6 is rounded on the end projecting radially outward in the illustrated embodiment. Swinging of the lever 11 or 12 around their common axis 17 first presses actuating part 6 radially back. In this case, the angular position of guiding edge 23 is altered relative to the external, rounded edge of actuating part 6 and a force component that is tangentially directed relative to rotor 5 arises, which can cause resetting of the rotor 5.

Control edges 22 of legs 18, 19, 20, 21 are configured in the embodiment presented, so that they have an incline match of to the force effect of the actuating part 6 during impact in the peripheral direction. This incline can vary widely since different force effects can be necessary.

The description of the door lock becomes complete by making reference to the fact that, in the illustrated embodiment, outside locking lever 9 has an actuating lug 24 which, in the case of anti-theft locking lever 12 being in the anti-theft locking position, brings the anti-theft locking lever 12 into the anti-theft unlocking position in the case of an unlocking movement. It can also be seen that inside opening lever 7 is inactive in the anti-theft locking position.

FIG. 1 shows the door lock in an unlocked position. In the case of a serviceable central interlock drive 2, with the rotor 5 untriggered, the actuating part 6 is in neutral position N. Pulling on the inside opening lever 7 with the aid of Bowden cable 8, or with the aid of a force effect from the outside opening lever, moves the driver pin **7*b* in the elongated hole 12*a* of antitheft locking lever 12 in FIG. 1 leftward, and thus, swings the power transmission lever 13 counterclockwise around the common pivot axis 25. Driver pin 15 of the detent pawl runs downward in the curved elongated hole 9*b* of outside locking lever 9** and operates the detent pawl to be raised from the rotary latch.

Figure 2:
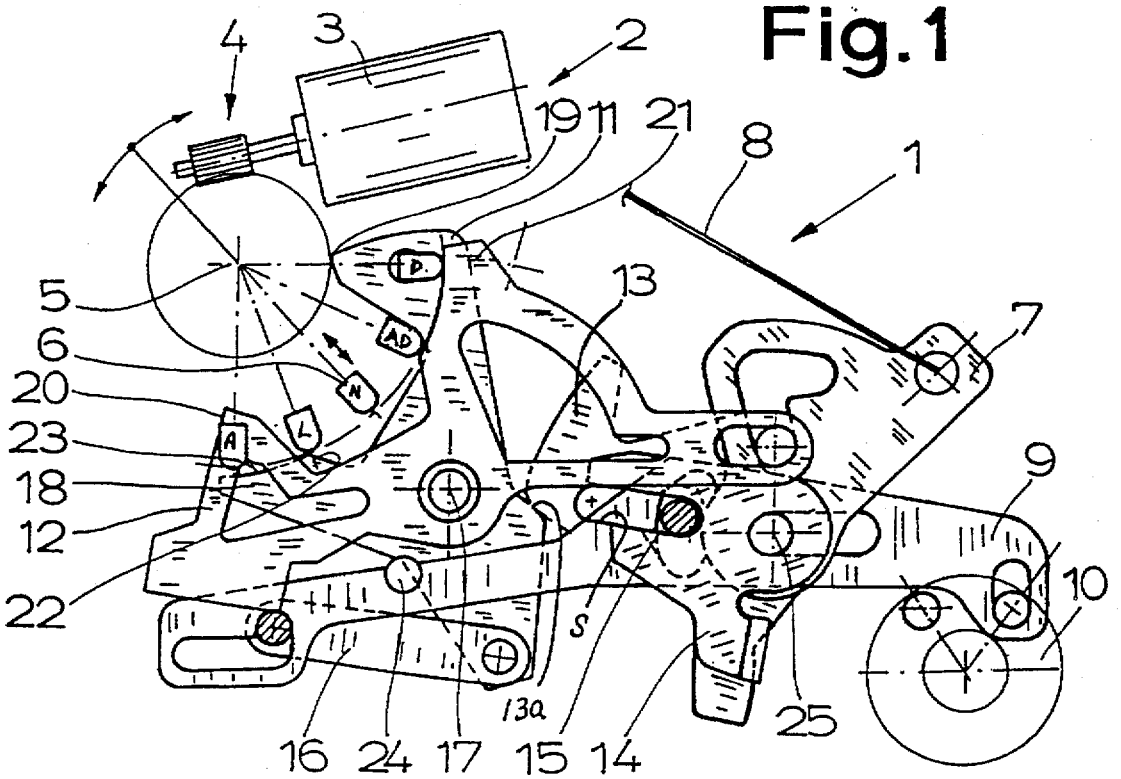
FIG. 2 shows the lock mechanism of FIG. 1 in the locking position.

If central interlock drive 2 is turned on so that rotor 5 rotates clockwise, thus in the locking direction, actuating part 6 laterally pushes the control edge 22 on the left leg 18 of the central interlock lever 11, and swings central interlock lever 11 counterclockwise around axis 17. In this case, leg 18 is deflected and leaves the path of movement of the actuating part 6, so that the actuating part can reach locking position L, while the opposite leg 19 is swung into the path of movement and lies there with its control edge. Simultaneously, via connecting lever 16, the outside locking lever 9 in FIG. 1 is pulled toward the right and nut 10 rotates clockwise into the locking position. Driver pin 15 is pushed so far in the elongated slot S of the power transmission lever 13, that it comes to lie on the right in a fork-like extension. This fork-like extension of the slot S in the power transmission lever 13 is indicated in dashed lines in FIG. 1, 2 close to the pivot axis 25. You should be well aware of the fact that there is an elongated slot in the intermediate lever 14 which is mostly coinciding with slot S in the power transmission lever 13 apart from the left end of this slot in the intermediate lever 14 which is not closed but open. You can see this in FIG. 2. The thus achieved locking position is depicted in FIG. 2. In this position, if pin 15 is caused to move downward, it moves downward within the fork-like extension of the elongated slot S in the power transmission lever 13, so that no movement of lever 13 is produced and thus, no movement of the detent pawl results.

The position depicted in FIG. 2 can also be achieved by mechanical actuation of the door lock cylinder, thus of nut 10. If, in the locking position of FIG. 2, Bowden cable 8 is pulled, a disengagement of the lock, thus a return toward FIG. 1, becomes possible by the left transmission surface **13*a* of the power transmission lever 13 pressing on the opposite surface of central interlock lever 11, and the central interlock lever 11 swinging back around axis 17 in a clockwise direction to the release position from FIG. 1. This, of course, first requires that rotor 5 with actuating part 6 has again occupied the neutral position N. Otherwise, the overload function of actuating part 6** must occur.

Figure 3:
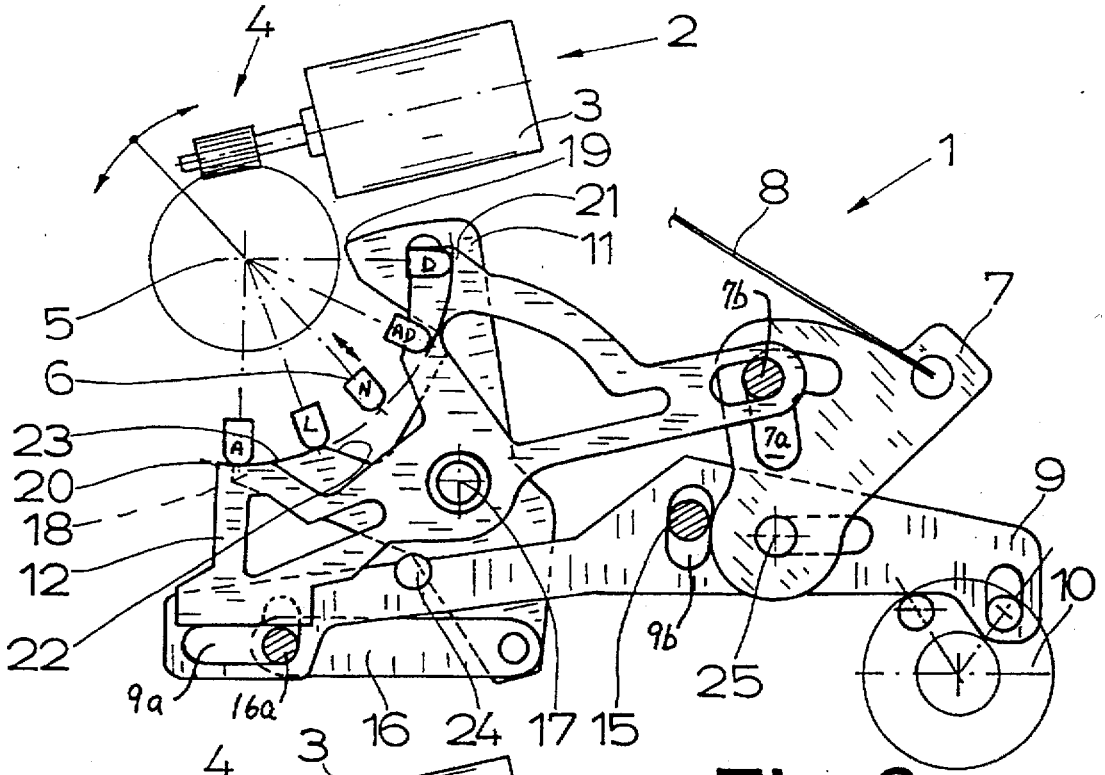
FIG. 3 shows the lock mechanism of FIG. 1 in the anti-theft locking position.

FIG. 3 shows the anti-theft locking position of the motor vehicle door lock according to the invention, the intermediate lever 14 and the power transmission lever 13 being omitted to illustrate the movements of the pins **7*b*, 15 and 25 more clearly (the same being true for FIG. 4 described below). Here, rotor 5 with actuating part 6 has been swung until it is in the anti-theft locking position A of the actuating part 6. Normally, it returns naturally to neutral position N. It is seen that anti-theft locking lever 12 is now also swung into the path of movement of actuating part 6, central interlock lever 11 and anti-theft locking lever 12 have their right legs 19, 21** now projecting into the path of movement.

By the thus completed swinging of anti-theft locking lever 12 counterclockwise around axis 17, the drive pin **7*b* has been shifted upward within a first branch of the angular hole 7*a* of inside opening lever 7 into the area of the junction of the branches of the angular hole 7*a* of inside opening lever 7. If, now, the Bowden cable 8 is pulled, inside opening lever 7 executes an idle stroke, in which the pin 7*b* inactively (i.e., without functional effect on the unlocking processes) moves down the second branch of angular hole 7*a* (i.e., to the right in FIG. 3). Pulling on the inside opening handle has no effect whatsoever on lock mechanism 1. 0f course, the same hold for pulling on the outside opening handle, but this already applies for the locking position according to FIG. 2**.

In the embodiment presented, it can be seen, moreover, that in the anti-theft locking position of FIG. 3, the central interlock lever 11 is also decoupled from the outside locking lever 9, specifically, by the driver pin **16*a* on the left end of connecting lever 16 having been pressed downward by anti-theft locking lever 12 into the area of the transversely elongated portion of the hole 9*a* in the outside locking lever 9. As a result, movement of central interlock lever 11 moves the driver pin 16*a* into the transversely elongated portion of hole 9*a* (i.e., to the left in FIG. 3**) with no effect.

Figure 4:
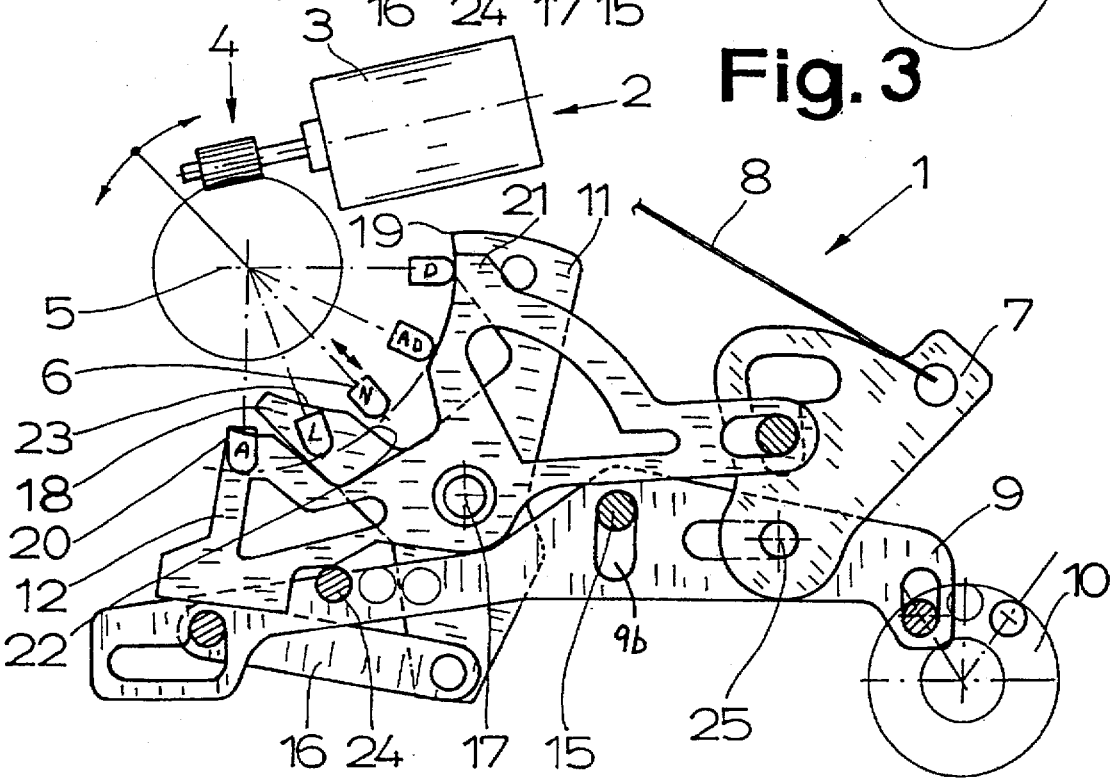
FIG. 4 shows the lock mechanism of FIG. 1 in transition from the anti-theft locking position of FIG. 3 to an emergency unlocking opening position.

If, in the case of the anti-theft locking position shown in FIG. 3, however, outside locking lever 9 is now actuated from the door locking cylinder via nut 10 to turn in the unlocking direction, thus clockwise, the function that is depicted in FIG. 4 takes place. Outside locking lever 9 is again moved leftward starting from FIG. 3. In this case, actuating lug 24 strikes an inclined control edge on the underside of the anti-theft locking lever 12. The anti-theft locking lever 12 is swung clockwise around the axis 17. Via connecting lever 16, the central interlock lever 11 is simultaneously also swung clockwise around axis 17. The unlocked position depicted in FIG. 4 is again achieved.

It is interesting in any case that in case of emergency, actuating part 6 can deflect on rotor 5 radially against the spring force, depicted by the double arrow in FIG. 1, and thus an emergency unlocking is always possible, even if central interlock drive 2 should block.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

I claim:

1. In a motor vehicle door lock with locking elements including a rotary latch and a detent pawl, a lock mechanism and a central interlock drive, in which the central interlock drive has a drive motor, a rotor rotatably driven by the drive motor and an actuating part arranged on the rotor which is displaceable into each of a release position, a locking position, an anti-theft locking position and a neutral position; wherein the locking mechanism has an inside opening lever, an outside opening lever as well as a central interlock lever which is displaceable by said actuating part; and wherein the actuating part on the rotor is radially displaceable relative to the rotor, is spring-loaded in a radially outward direction and is radially deflectable against the spring-loading when the central interlock drive is blocked in an intermediate position for allowing release of the detent pawl from engagement with the rotary latch to enable unlocking of the door lock.

2. Motor vehicle door lock according to claim 1, wherein the rotor with the actuating part is arranged to always return to the neutral position.

3. Motor vehicle door lock according to claim 1, wherein the lock mechanism has an anti-theft locking lever that is displaceable by the actuating part.

4. Motor vehicle door lock according to claim 3, wherein at least one of the central interlock lever and the anti-theft locking lever is mounted on an axis parallel to an axis of rotation of the rotor and has U-shape with a first leg which projects with a control edge into a path of movement of the actuating part and a second leg with a guiding edge that lies on an edge of the path of movement of the actuating part.

5. Motor vehicle door lock according to claim 4, wherein each of said legs has both a said control edge and a said guiding edge.

6. Motor vehicle door lock according to claim 5, wherein the guiding edge runs orthogonally to a radial direction of the rotor when positioned on the edge of the path of movement of the actuating part.

7. Motor vehicle door lock according to claim 5, wherein each control edge has an incline matched to a force effect of the actuating part during impact in a peripheral direction.

8. Motor vehicle door lock according to claim 3, wherein the outside locking lever has an actuating lug for shifting the anti-theft locking lever from the anti-theft locking position into an anti-theft release position during a release movement of the outside locking lever.

9. Motor vehicle door lock according to claim 3, wherein the inside opening lever is inactive in the anti-theft locking position.

10. Motor vehicle door lock according to claim 1, wherein the inside opening lever is inactive in the anti-theft locking position.

11. Motor vehicle door lock according to claim 1, wherein the actuating part is mounted in a movable manner on the rotor.

* * * * *